US005618069A

United States Patent [19]

Konchan et al.

[11] Patent Number: 5,618,069

[45] Date of Patent: Apr. 8, 1997

[54] HOOD AND DECKLID LATCH ASSEMBLIES

[75] Inventors: Jeffrey L. Konchan, Shelby Township; David Kowalczyk, Macomb, both of Mich.; John F. Reelhorn, Pickerington; Dennis F. Saxton, Orient, both of Ohio

[73] Assignee: General Motors Corporation, Detroit, Mich.

[21] Appl. No.: 505,433

[22] Filed: Jul. 21, 1995

[51] Int. Cl.[6] ..... E05B 15/02

[52] U.S. Cl. ..... 292/216; 292/341.17; 292/DIG. 14; 292/DIG. 38; 292/DIG. 56

[58] Field of Search ..... 292/341.17, 341.12, 292/341.15, DIG. 14, 216, 341.11, DIG. 55, DIG. 56, DIG. 57, DIG. 38

[56] References Cited

U.S. PATENT DOCUMENTS

| | | | |
|---|---|---|---|
| 2,814,193 | 11/1957 | Roethel | 70/142 |
| 2,877,038 | 3/1959 | Kramer | 292/216 |
| 3,572,793 | 3/1971 | Cole | 292/216 |
| 3,905,624 | 9/1975 | Fujita | 292/11 |
| 3,985,381 | 10/1976 | Kobayashi | 292/216 |
| 4,130,308 | 12/1978 | Jeavons | 292/216 |
| 4,357,039 | 11/1982 | Tolle | 292/341.12 |
| 4,358,141 | 11/1982 | Hamada | 292/216 |
| 4,456,289 | 6/1984 | Badiali | 292/28 |
| 4,538,845 | 9/1985 | Yamada | 292/216 |
| 4,756,564 | 7/1988 | Ikeda | 292/216 |
| 4,783,103 | 11/1988 | Schlegel | 292/216 |
| 4,854,617 | 8/1989 | Hayakawa et al. | 292/216 |
| 4,896,907 | 1/1990 | Hayakawa et al. | 292/216 |
| 4,898,414 | 2/1990 | Yamada | 292/337 |
| 4,917,420 | 4/1990 | Rogers, Jr. | 292/198 |
| 4,961,601 | 10/1990 | Lindholm et al. | 292/216 |
| 5,064,229 | 11/1991 | Hamada et al. | 292/216 |
| 5,118,146 | 6/1992 | Watanuki | 292/216 |
| 5,181,754 | 1/1993 | Shibata | 292/216 |
| 5,328,219 | 7/1994 | Konchan et al. | 292/216 |
| 5,348,355 | 9/1994 | Oyha | 292/11 |
| 5,445,421 | 8/1995 | Ferrara | 292/216 |

*Primary Examiner*—Steven N. Meyers
*Assistant Examiner*—Donald J. Lecher
*Attorney, Agent, or Firm*—Cary W. Brooks

[57] ABSTRACT

The present invention generally includes a latch assembly including a completely symmetrical metal frame and a polymeric isolation plate mounted between the frame and levers. The polymeric isolation plate is not symmetrical but serves as a templet to assure that only the proper holes are being used on the metal frame for either right-hand or left-hand drive latch assemblies. The polymeric isolation plate also includes integral cylindrical bushings. Detent and fork-bolt levers are trapped onto the respective bushings by metal rivets so that the levers actually rotate on the low friction bushings and not on the metal rivets. The isolator plate includes an integral flange which is interposed between the striker of the vehicle and the throat of the frame to avoid rubbing metal-to-metal contact, to protect the throat, frame and striker and for quieter operation. A rivet for holding a secondary lever has an enlarged flattened head which minimizes bypass of the fork-bolt and detent lever while also supporting the secondary lever. The enlarged flattened head eliminates the need for a cover plate to minimize bypass of the detent and fork-bolt lever. The latch can be used for a hood latch assembly, or a decklid latch assembly wherein the secondary lever is not required, and is designed to be built on a common set of asm equipment for right- and left-drive and hood/decklid versions.

13 Claims, 4 Drawing Sheets

HOOD AND DECKLID LATCH ASSEMBLIES

This invention relates to a latch assembly for latching and unlatching a hood or decklid in a vehicle.

BACKGROUND OF THE INVENTION

It is well known in motor vehicles to have a hood which carries a striker. It is also well known to have a latch assembly mounted to the vehicle for latching and unlatching the hood. A conventional latch assembly includes a housing having a throat for receiving the striker. Typically a fork-bolt lever is pivotally mounted to the housing for movement between a latched position for capturing the striker in the housing throat to latch the hood and an unlatched position for releasing the striker to unlatch the hood. The latch assembly also typically includes a detent lever for selectively engaging the fork-bolt lever in the latched position. A cable is attached to the detent lever and is routed to the hood release handle mounted adjacent a vehicle driver. The driver pulls the handle which pulls the cable causing the detent lever to disengage from the fork-bolt lever to release the striker and unlatch the hood.

It is becoming increasingly common in a global economy to produce vehicles having a left-drive version and a right-drive version. A conventional latch assembly can be made in a left-hand version and a right-hand version by manufacturing and assembling a different housing, fork-bolt and detent lever. The prior art also recognizes that a housing having a central throat may be used with a left-drive or right-drive vehicle. However, redundant manufacturing operations must be performed to produce duplicate left-hand and right-hand mounting holes in the housing for pivot pins to support a fork-bolt lever and a detent lever. The requirement of different components and different or redundant manufacturing and assembling operations adds time and costs to producing latch assemblies.

The present invention provides many advantages over the prior art.

SUMMARY OF THE INVENTION

The present invention generally includes a latch assembly including a completely symmetrical metal frame and a polymeric isolation plate mounted between the frame and levers. The polymeric isolation plate is not symmetrical but serves as a templet to assure that only the proper holes are being used on the metal frame for either right-hand or left-hand drive latch assemblies. The polymeric isolation plate also includes integral cylindrical bushings. Detent and fork-bolt levers are trapped onto the respective bushings by metal rivets so that the levers actually rotate on the low friction bushings and not on the metal rivets. The insulator plate includes an integral flange which is interposed between the striker of the vehicle and the throat of the frame to avoid rubbing metal-to-metal contact, to protect the throat, frame and striker and for quieter operation. A rivet for holding a secondary lever has an enlarged flattened head which minimizes or serves to reduce the possibility of bypass of the fork-bolt and detent lever while also supporting the secondary lever. The enlarged flattened head eliminates the need for a cover plate to minimize or serve to reduce the possibility of bypass of the detent and fork-bolt lever. The latch can be used for a hood latch assembly, or a decklid latch assembly wherein the secondary lever is not required.

These and other objects, features and advantages of the present invention will become apparent upon consideration of the following brief description of the drawings, detailed description, appended claims and accompanying drawings.

DETAILED DESCRIPTION

Figure 3:
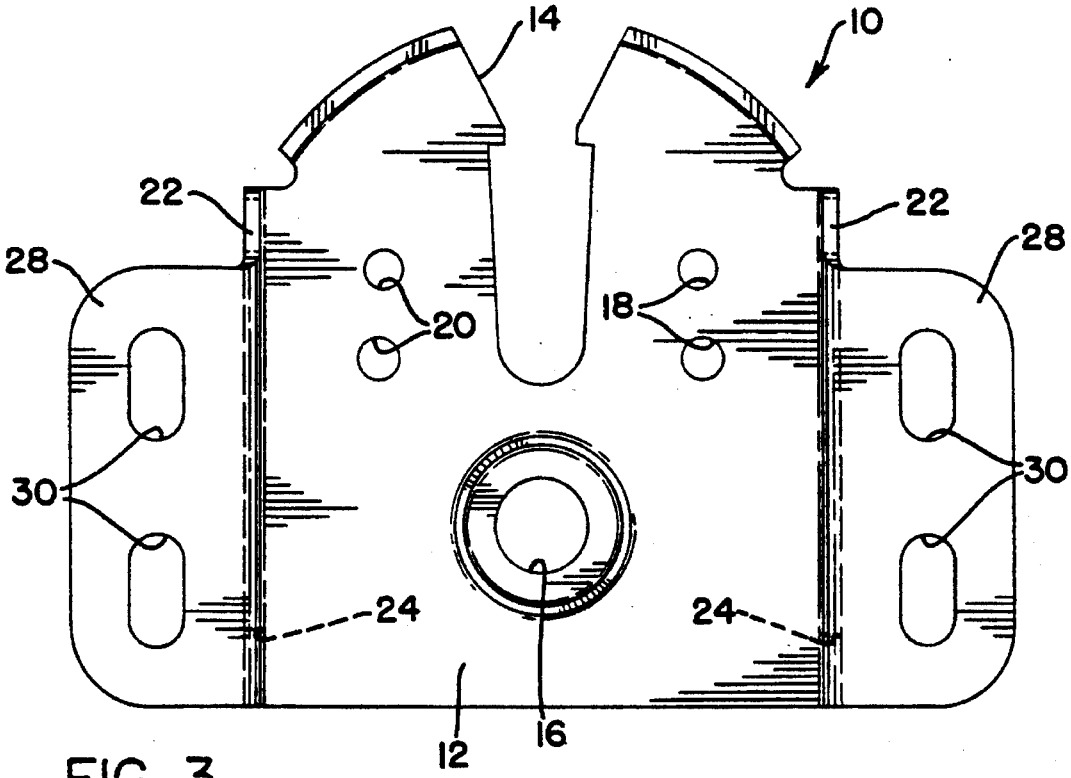
FIG. 3 is a view of the symmetrical frame or housing used in a latch assembly according to the present invention.
Figure 4:
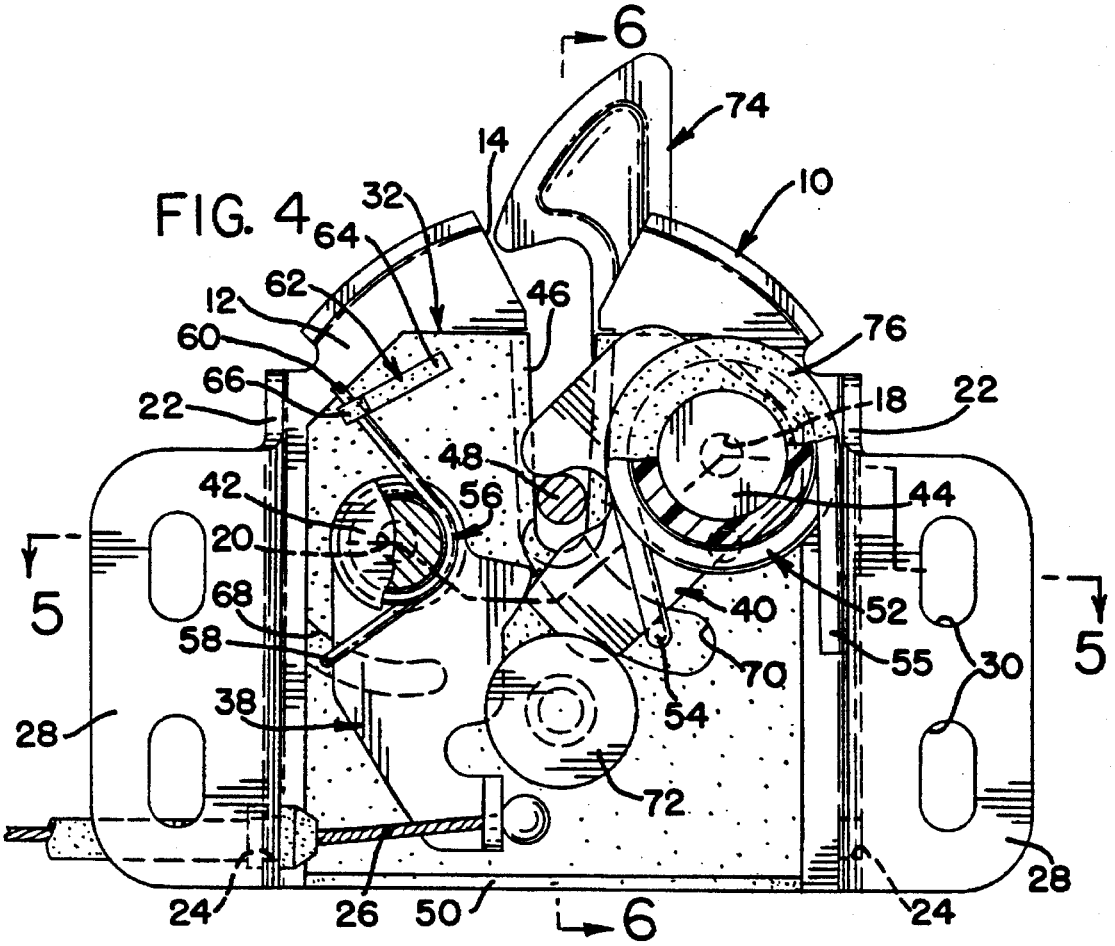
FIG. 4 is a view of the right-hand latch of FIG. 2 assembly according to the present invention with portions broken away.

Latch assemblies according to the present invention are illustrated in FIGS. 1–2 and 4–6. The latch assemblies are constructed off a common housing or frame 10 illustrated in FIG. 3. The frame 10 is symmetrical in configuration and construction, and includes a flat face 12 having a striker entry cutout or throat 14. Underneath the throat is a hole 16 for receiving a secondary lever shoulder stud described hereafter. A pair of lever mounting holes 18,20 are symmetrically positioned both to the left and the right of the throat. Extending from the flat face are a pair of opposed side walls 22. A hole 24 is formed at the lower end of each side wall 22 through which a release cable 26 may be threaded and connected to the detent lever 38. A mounting flange 28 extends outwardly from each side wall and includes two mounting holes 30 formed therein for mounting the assembly to the vehicle. Since the frame is symmetrical in configuration it can be utilized for both right-handed and left-handed drive latch assemblies.

Figure 1:
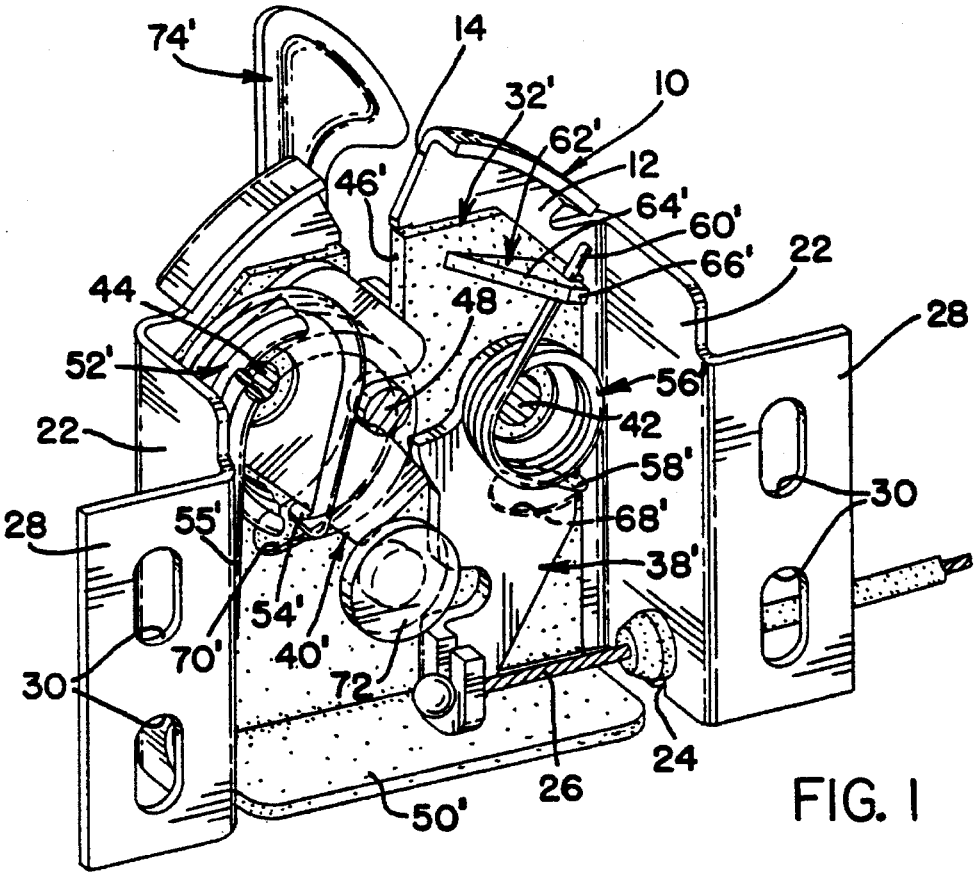
FIG. 1 is a rear view of a left-hand latch assembly according to the present invention shown in a latched position and assembled for capturing the striker in a throat so that the hood or decklid is latched by pulling a cable on a left side of a vehicle.
Figure 2:
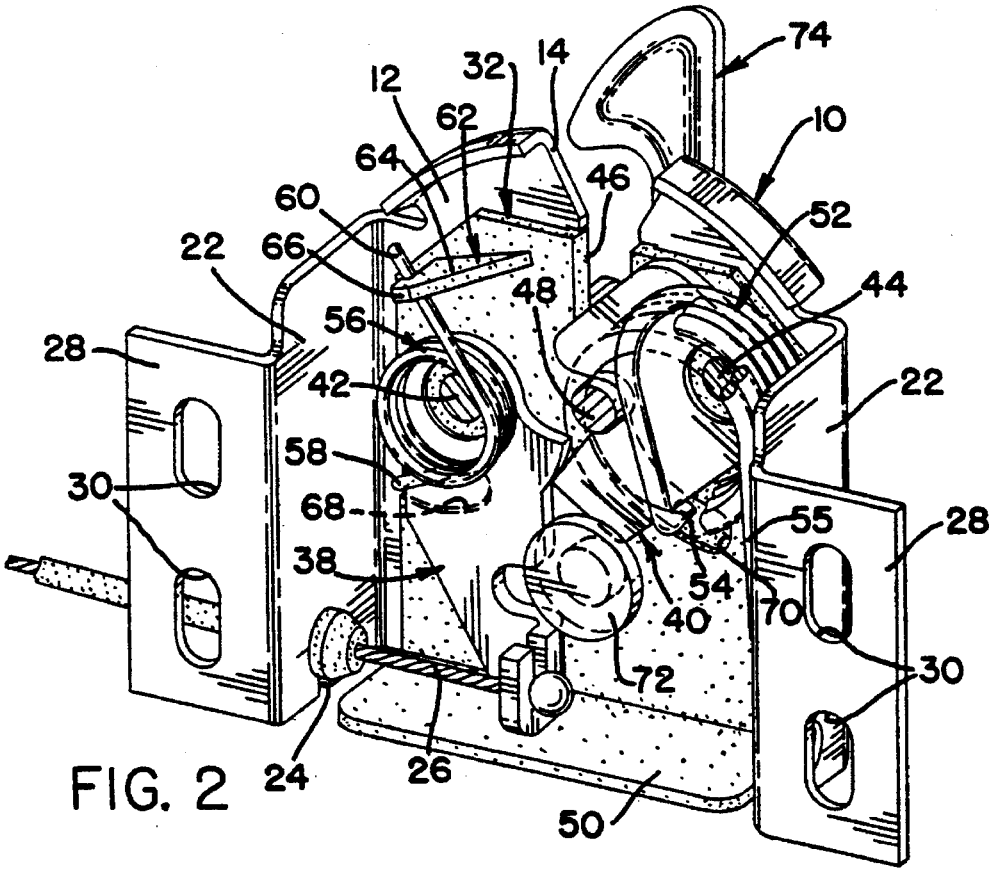
FIG. 2 is a rear view of a right-hand latch assembly according to the present invention shown in a latched position and assembled for capturing the striker in a throat so that the hood or decklid is latched by pulling a cable on the right side of the vehicle.

The following description is directed to the right-hand assembly as viewed in FIGS. 2 and 5–7 but also applies to the left-hand version shown in FIG. 1 where similar parts of the opposite hand that are not interchangeable are referenced with like numbers but primed. Parts without primed numbers can be used on either right- or left-hand assemblies.

Figure 5:
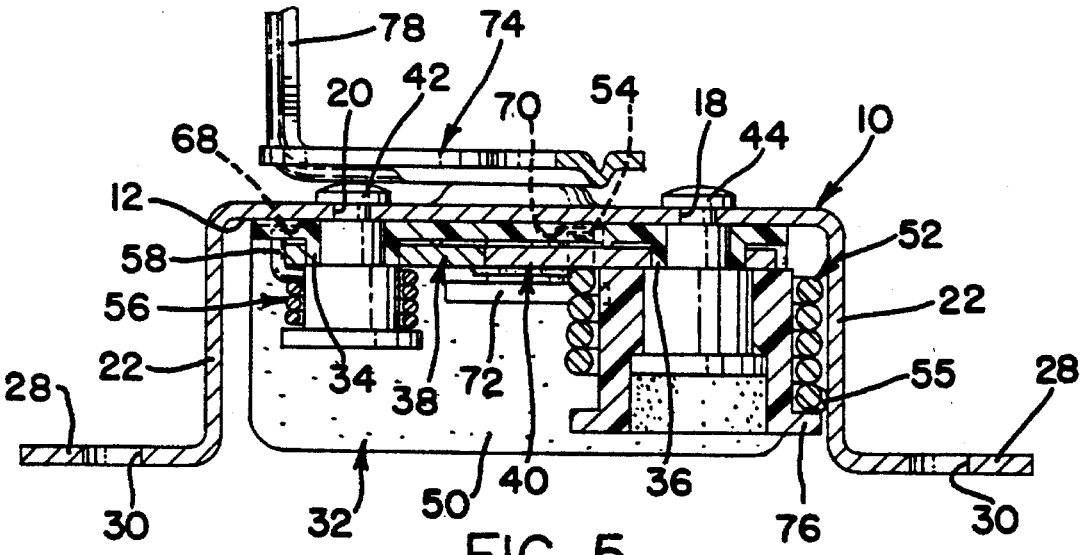
FIG. 5 is a cross-sectional view of a latch assembly taken as indicated by line 5—5 of FIG. 4.
Figure 6:
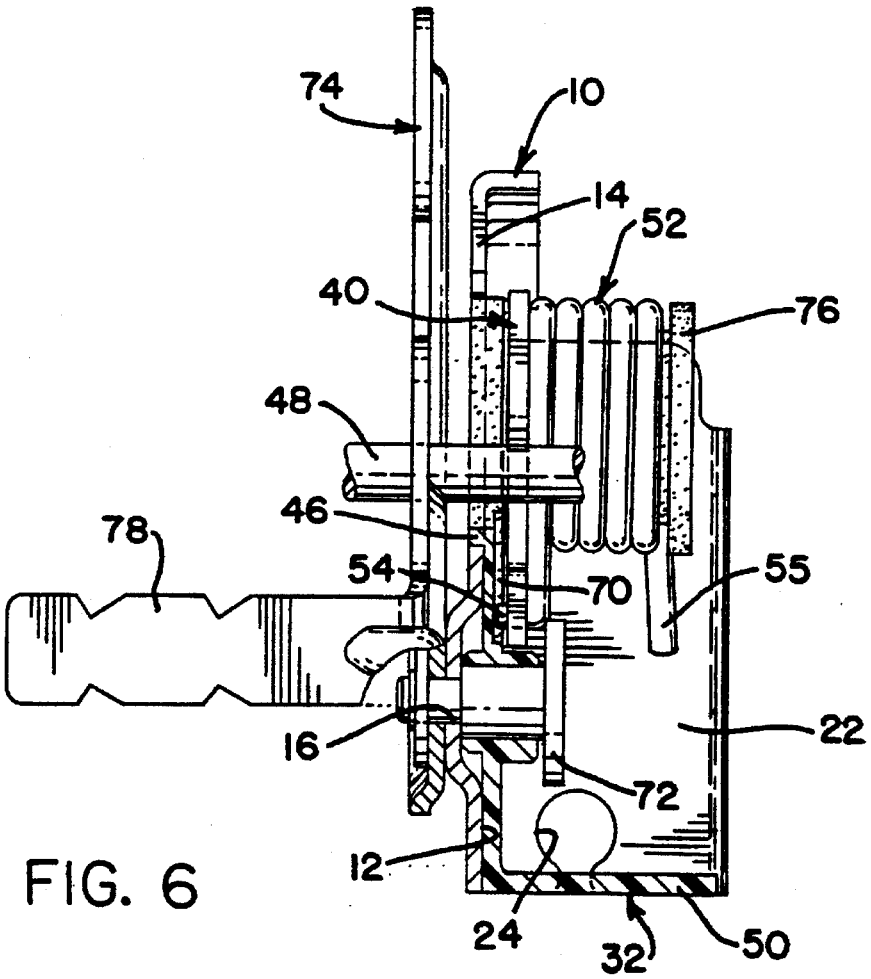
FIG. 6 is a cross-sectional view of a latch assembly taken as indicated by line 6—6 of FIG. 4.
Figure 7:
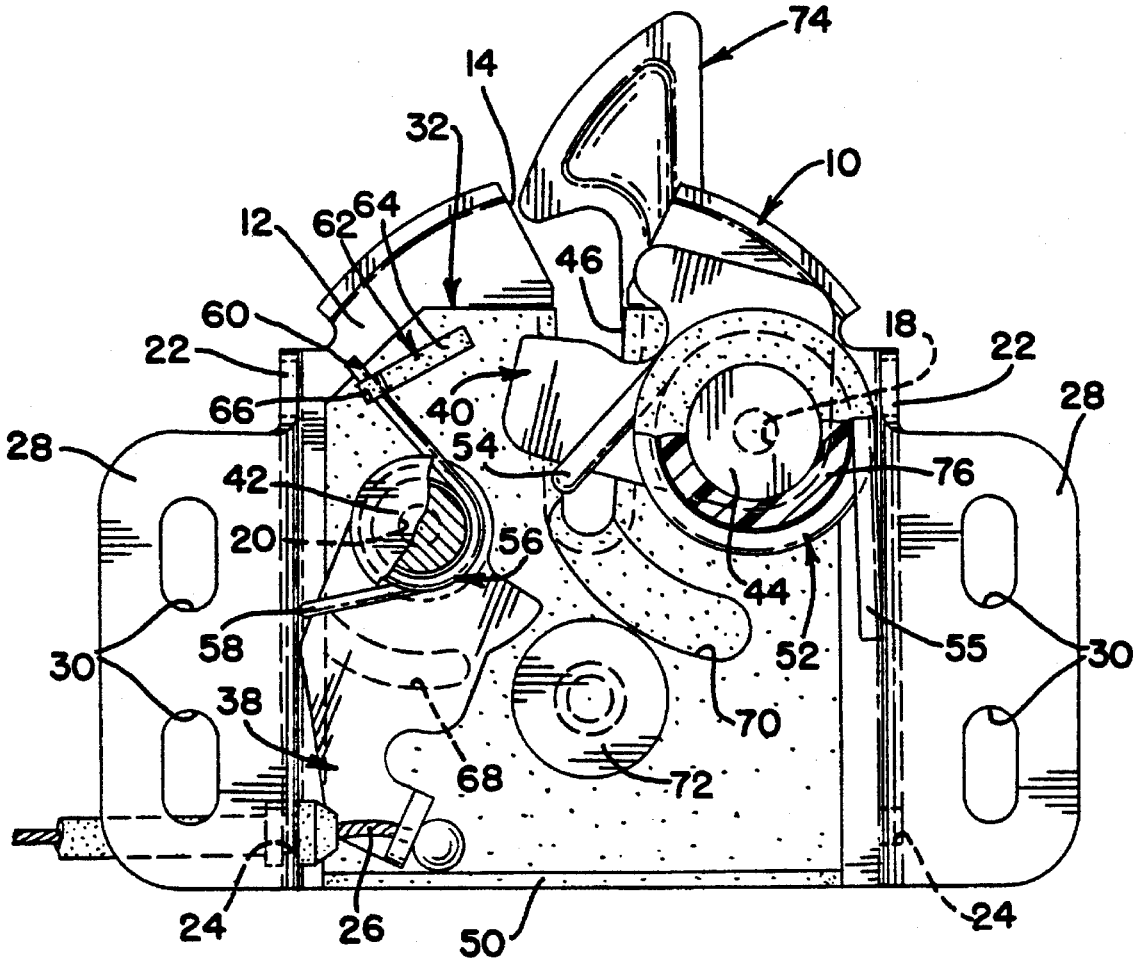
FIG. 7 illustrates the right-hand latch assembly according to the present invention with the latch release cable pulled in an unlatched position.

The latch assembly includes a polymeric isolation plate 32 which is mounted between the frame and levers to be described hereafter. The polymeric isolation plate is not symmetrical but serves as a templet to assure that only the proper holes are being used on the metal frame for either a right-hand or a left-hand drive latch assembly. The polymeric isolation plate is a one-piece structure which includes integral cylindrical bushings 34,36 (FIG. 5). A detent and fork-bolt levers 38,40 respectively, are tapped into their respective bushings by metal rivets 42,44 such that the levers actually rotate on low friction cylindrical bushings of the polymeric isolation plate and not on the metal rivets as is typical with prior art assemblies. The isolation plate also includes an integral flange 46 which is interposed between the striker 48 on the vehicle and the throat of the frame to avoid rubbing metal-to-metal contact, to protect the throat of the frame and the striker and for quieter operation. An outwardly extending ledge 50 is formed at the lower end of the polymeric isolation plate and is constructed and arranged to block and prevent someone from hooking the detent lever from underneath the car and opening the hood. The polymeric isolation plate may be made from a plastic such as a polyacetal based material.

Whether the assembly is for a right-hand or left-hand drive system, the fork-bolt 40 is biased away from the throat of the frame by a coil metal spring 52 which has one leg 54 engaging the fork-bolt 40 and the other leg 55 engaging the outwardly extending side wall 22 of the frame. The detent lever 38 is biased towards the center axis of the frame by a coil spring 56 which has one leg 58 engaging the detent lever 38 and another leg 60 which engages a stop 62 formed on the polymeric isolation plate. As illustrated in FIGS. 1–2 and 4–6, the stop may be an outwardly extending arm 64 and hook finger 66 combination which serves to capture the leg of the spring. Cutouts 68,70 are provided in the isolation plate for spring leg clearance which bias the detent lever and fork-bolt.

When the striker 48 engages the fork-bolt 40, the fork-bolt is pivoted downward to a latch position where the detent lever blocks 38 the fork-bolt 40 from being biased away from the throat to the unlatched position. When the release cable 26 is pulled, the detent lever is pivoted out of engagement with the fork-bolt allowing the fork-bolt to move to the unlatched position.

A steel rivet or long plastic journal 72 extends through the hole 16 beneath the throat in the frame to hold on a secondary latch hood lever 74. The rivet includes an enlarged flattened head which minimizes or serves to reduce the possibility of bypass of the fork-bolt and detent lever and thus eliminates the need for a cover plate.

A spring retainer 76 may be utilized such as a plastic cap that fits on the shoulder of a rivet to hold the coil spring. The secondary latch hood lever includes a bent arm 78 which receives a snap-on handle grip extension (not shown) for releasing the secondary latch lever and opening the hood.

The present invention is unique in that the latch can be used as a hood latch assembly and a decklid latch assembly. However, the hood latch only uses a secondary lever, stud and spring. Further, the hood latch uses a higher output pop-up spring on the fork-bolt, wherein the spring has a larger diameter and requires a plastic cap 76 on the rivet. The decklid latch uses a small spring on the folk-bolt and does not requires a plastic cap on the rivet.

The latch is designed to easily configurable in hood or decklid latch formats, addressing the product requirements of both vehicle apertures, while still allowing assembly of the latch on common assembly equipment. Competitor's approach has been to provide latches of completely differing designs; one for the hood latch and another for the decklid latch. By using the primarily common design, development cost and investment for assembly equipment is essentially halved and the product volume is essentially doubled (lowering piece cost and increasing sales dollars), resulting in a much stronger business case. Design is easily configurable for right-hand or left-hand drive vehicles with very little added investment, as design exhibits symmetry of shape and functional features, which allows most of the same components to be assembled in either configuration on the same equipment.

What is claimed is:

1. A latch assembly for a vehicle comprising:

a frame for right-hand and left-hand drive side latch assemblies, the frame including a panel having a throat formed therein for receiving a striker, first and second pairs of lever mounting holes symmetrically formed on each side of the throat, a mounting hole underneath the throat, a pair of opposed side walls extending upwardly from a front side of the panel, each side wall having a hole formed near the lower end thereof for receiving a cable, and a mounting flange extending outwardly from each side wall and having holes formed therein for mounting the frame to a vehicle;

a polymeric isolation plate having a notch defined therein and constructed and arranged when overlapping the frame to provide an integral flange which is interposed between a striker to be received in the notch, and the throat of the panel to avoid rubbing between the striker and the panel and for quieter operation, said polymeric isolation plate includes holes formed therein corresponding to one hole of each pair of lever mounting holes formed on the sides of the throat of the panel and wherein the polymeric isolation plate blocks the other hole of each pair of holes to selectively provide only one of a right-hand or left-hand drive latch assemblies, said isolation plate including integral bushings associated with the lever mounting holes in the isolation plate;

a detent lever and a fork-bolt lever respectively received on one of said bushings and held in place by a rivet and constructed and arranged so that each lever rotates on a low friction polymeric isolation plate cylindrical bushing;

a spring operatively connected to the fork-bolt lever for biasing the fork-bolt lever away from the throat;

a spring operatively connected to the detent lever for biasing the detent lever towards to the central axis of the frame and wherein said polymeric isolation plate further comprises an outwardly extending ledge near the lower end constructed and arranged to prevent the detent lever from being hooked from underneath the vehicle when the latch assembly is installed in a vehicle.

2. A latch assembly for a vehicle comprising:

a frame for right-hand and left-hand drive side latch assemblies, the frame including a panel having a throat formed therein for receiving a striker, a first pair of lever mounting holes formed in the frame on a first side of the throat and a second pair of lever mounting holes formed in the frame on a second side of the throat, a mounting hole underneath the throat, a pair of opposed side walls extending upwardly from a front side of the panel, each side wall having a hole formed near the lower end thereof for receiving a cable, and a mounting flange extending outwardly from each side wall and having holes formed therein for mounting the frame to a vehicle;

a polymeric isolation plate having a notch defined therein and constructed and arranged when overlapping the frame to provide an integral flange which is interposed between a striker to be received in the notch, and the throat of the panel to avoid rubbing between the striker and the panel and for quieter operation, said polymeric isolation plate includes holes formed therein corresponding to one hole of each pair of lever mounting holes formed on the sides of the throat of the panel and wherein the polymeric isolation plate blocks the other hole of each pair of lever mounting holes to selectively provide only one of a right-hand or left-hand drive latch assemblies, said isolation plate including integral bushings associated with the lever mounting holes in the isolation plate;

a detent lever and a fork-bolt lever respectively received on one of said bushings and held in place by a rivet and constructed and arranged so that each lever rotates on a low friction polymeric isolation plate cylindrical bushing;

a spring operatively connected to the fork-bolt lever for biasing the fork-bolt lever away from the throat;

a spring operatively connected to the detent lever for biasing the detent lever towards to the central axis of the frame.

3. A latch assembly as set forth in claim 2 further comprising a secondary latch hood lever located on a backside of the panel and held in place by a secondary lever shoulder stud extending through the hole underneath the throat in the panel, said secondary lever hood stud including an enlarged flattened head constructed and arranged to minimize bypass of the fork-bolt lever and the detent lever.

4. A latch assembly as set forth in claim 2 wherein said stud is steel.

5. A latch assembly as set forth in claim 2 wherein each pair of lever mounting holes formed in the frame includes a first hole position substantially above a second hole and wherein the rivet extends through the detent lever and into one of the first and second holes on one side of the throat of the frame and a rivet extends through the fork-bolt lever and into the other of the first and second holes on the other side of the throat of the frame.

6. A latch assembly as set forth in claim 2 wherein said frame comprises and first and second lever mounting hole formed on one side of the throat and a third and fourth mounting hole formed on the other side of the throat.

7. A latch assembly as set forth in claim 6 wherein the first hole is formed substantially above the second hole and the third hole is formed substantially above the fourth hole.

8. A latch assembly as set forth in claim 7 wherein a rivet extends through the detent lever and into the third hole and a rivet extends through the fork-bolt lever and into the second hole.

9. A latch assembly as set forth in claim 8 wherein a rivet extends through the detent lever and into the fourth hole and a rivet extends through the fork-bolt lever and into the first hole.

10. A latch assembly as set forth in claim 2 wherein a coil spring has a first leg engaging the detent lever and a second leg engaging a stop formed on and extending outwardly from the polymeric isolation plate.

11. A latch assembly as set forth in claim 10 wherein said stop comprises an outwardly extending arm and hooked finger constructed and arranged to capture the second leg of the coil spring.

12. A latch assembly as set forth in claim 11 wherein said stop is formed at an upper right-hand corner of the isolation plate when viewing the isolation plate in a position overlying the frame.

13. A latch assembly as set forth in claim 11 wherein the stop is formed in an upper left-hand corner of the isolation plate when viewing the isolation plate in a position overlying the frame.

* * * * *